US007372356B2

(12) United States Patent
Lee

(10) Patent No.: US 7,372,356 B2
(45) Date of Patent: May 13, 2008

(54) CONCEALED ADJUSTABLE TEMPERATURE SWITCH

(75) Inventor: Grace Lee, Chia Yi Hsien (TW)

(73) Assignee: Homeease Industrial Co., Ltd. (TW)

( * ) Notice: Subject to any disclaimer, the term of this patent is extended or adjusted under 35 U.S.C. 154(b) by 379 days.

(21) Appl. No.: 11/262,730

(22) Filed: Nov. 1, 2005

(65) Prior Publication Data

US 2007/0096862 A1 May 3, 2007

(51) Int. Cl.
*H01H 37/20* (2006.01)
*H01H 37/30* (2006.01)
*H01H 37/12* (2006.01)

(52) U.S. Cl. ..... 337/360; 337/377; 337/347; 337/357; 337/368; 337/374

(58) Field of Classification Search ..... 337/377, 337/347, 357, 360, 368, 374
See application file for complete search history.

(56) References Cited

U.S. PATENT DOCUMENTS 2,298,195 A * 10/1942 Clark et al. ..... 337/57
2,374,022 A * 4/1945 Lee ..... 337/69
2,689,897 A * 9/1954 Lee ..... 337/372
2,716,175 A * 8/1955 Franklin ..... 337/341
2,740,864 A * 4/1956 Tai ..... 337/375
2,774,846 A * 12/1956 Lee ..... 337/375
2,786,115 A * 3/1957 Franklin ..... 337/67
3,328,743 A * 6/1967 Acord ..... 439/258
3,354,278 A * 11/1967 Piacent et al. ..... 337/84
3,381,100 A * 4/1968 Lee ..... 392/454
3,573,700 A * 4/1971 Schmitt ..... 337/347
3,587,022 A * 6/1971 Hire ..... 337/89
3,593,253 A * 7/1971 Taylor ..... 337/139
3,676,817 A * 7/1972 Bletz ..... 337/347
3,720,898 A * 3/1973 Levinn ..... 337/95
3,878,498 A * 4/1975 Allen et al. ..... 337/347
3,913,048 A * 10/1975 Mertler ..... 337/67
3,919,679 A * 11/1975 Kingma ..... 337/107

(Continued)

FOREIGN PATENT DOCUMENTS

FR 2508755 A * 12/1982

(Continued)

OTHER PUBLICATIONS

U.S. Appl. No. 10/961,196, filed Oct. 12, 2004, Lee.

*Primary Examiner*—Anatoly Vortman
(74) *Attorney, Agent, or Firm*—Stites & Harbison PLLC; Marvin Petry

(57) ABSTRACT

A concealed adjustable temperature switch includes a fixed plate, an adjusting block threadedly engaged with a screw hole of the fixed plate, a bimetal plate, and a metal plate. Mounted on the adjusting block are upper and lower positioning rings and a fixing ring between the positioning rings. The fixed ring includes a hole through which the adjusting block extends. The fixing ring includes a stop projecting toward the fixed plate. The stop includes two sides having a height greater than a thickness of the fixed plate. A distance between the stop and a center of the hole of the fixing ring is greater than that between a front edge of the fixed plate and a center of the screw hole of the fixed plate and than that between either one of two sides of the fixed plate to the center of the screw hole of the fixed plate.

2 Claims, 4 Drawing Sheets

U.S. PATENT DOCUMENTS

| | | | | | |
|---|---|---|---|---|---|
| 3,964,004 | A | * | 6/1976 | Mertler | 337/67 |
| 3,973,232 | A | * | 8/1976 | Hickling | 337/94 |
| 4,090,166 | A | * | 5/1978 | Burch | 337/360 |
| 4,109,136 | A | * | 8/1978 | Balchunas | 219/252 |
| 4,131,871 | A | * | 12/1978 | Haag et al. | 338/220 |
| 4,177,396 | A | * | 12/1979 | Wang | 310/68 C |
| 4,177,443 | A | * | 12/1979 | Willeke | 337/101 |
| 4,283,701 | A | * | 8/1981 | Ryckman, Jr. | 337/341 |
| 4,424,506 | A | * | 1/1984 | Burch | 337/365 |
| 4,495,481 | A | * | 1/1985 | Hickling et al. | 337/349 |
| 4,496,928 | A | * | 1/1985 | Hollweck | 337/94 |
| 4,587,508 | A | * | 5/1986 | Hollweck | 337/343 |
| 4,672,353 | A | * | 6/1987 | Ubukata et al. | 337/368 |
| 4,682,141 | A | * | 7/1987 | Hickling | 337/379 |
| 4,968,963 | A | * | 11/1990 | DeWitt et al. | 337/363 |
| 5,041,004 | A | * | 8/1991 | Waldorf | 439/306 |
| 5,101,189 | A | * | 3/1992 | Dolza et al. | 337/319 |
| 5,337,037 | A | * | 8/1994 | Guillot et al. | 337/363 |
| 5,548,266 | A | * | 8/1996 | Murphy | 337/360 |
| 5,719,736 | A | * | 2/1998 | Brenner et al. | 361/105 |
| 5,973,586 | A | * | 10/1999 | Mertler, Jr. | 337/299 |
| 2007/0024408 | A1 | * | 2/2007 | Lee | 337/360 |

FOREIGN PATENT DOCUMENTS

| | | | | |
|---|---|---|---|---|
| GB | 2168535 | A | * | 6/1986 |

* cited by examiner

CONCEALED ADJUSTABLE TEMPERATURE SWITCH

BACKGROUND OF THE INVENTION

1. Field of the Invention

The present invention relates to an adjustable temperature switch. More particularly, the present invention relates to a concealed adjustable temperature switch for an electric appliance such as a hot melt glue gun for preventing damage.

2. Description of the Related Art

A typical hot melt glue gun comprises a concealed adjustable temperature switch in a body thereof for adjusting the temperature for melting a solid glue stick into liquid. FIG. 5 of the drawings is a conventional hot melt glue gun comprising a body 4' and a concealed adjustable temperature switch 1' that is connected by wires 2' to a heating member 3'. The adjustable temperature switch 1' includes an adjusting block 11' with an outer threading 111', a fixed plate 12' with a screw hole 121', a bimetal plate 13', and a metal plate 14'. The bimetal plate 13' includes a first plate and a second plate that are bonded together, wherein the bimetal plate 13' has different bending extents at different temperatures. The outer threading 111' of the adjusting block 11' is threadedly engaged with the screw hole 121' of the fixed plate 12'. The bimetal plate 13' is electrically connected to an electrode, and the metal plate 14' is electrically connected to the other electrode.

A tool T can be extended into the body 4' to turn the adjusting block 11', moving the adjusting block 11' toward or away from the bimetal plate 13' to thereby cause the bimetal plate 13' to be in tight contact or loose contact with the metal plate 14'. When the adjusting block 11' is turned in a direction, the adjusting block 11' moves toward the bimetal plate 13' and causes the bimetal plate 13' to be in loose contact with the metal plate 14'. In this case, slight bending of the bimetal plate 13' at a relatively low temperature is sufficient to cause disengagement of the bimetal plate 13' from the metal plate 14', resulting in an open circuit. Thus, electricity supply to the heating member 3' is cut off.

On the other hand, when the adjusting block 11' is turned in a reverse direction, the adjusting block 11' moves away from the bimetal plate 13' and causes the bimetal plate 13' to be in tight contact with the metal plate 14'. In this case, greater bending of the bimetal plate 13' at a relatively high temperature is required to cause disengagement of the bimetal plate 13' from the metal plate 14' to cut off electricity supply to the heating member 3'.

However, since the adjustable temperature switch 1' is concealed in the body 4', the user could not know the contact between the bimetal plate 13' and the metal plate 14'. In a case that the user misjudges a tight contact as a loose contact and turns the adjusting block 11' in the tightening direction, the bimetal plate 13' will be in an overtight contact with the metal plate 14' such that great bending of the bimetal plate 13' still could not cause disengagement from the metal plate 14'. As a result, overheating of the heating member 3' occurs, leading to overload and damage. Further, excessive rotation of the adjusting block 11' may cause disengagement from the screw hole 121' of the fixed plate 12', leading to falling of the adjusting block 11'. On the other hand, if a loose contact is misjudged as a tight contact, the adjusting block 11' is turned in the wrong direction such that the bimetal plate 13' could not be in contact with the metal plate 14', resulting in an undesired open circuit.

Applicant's U.S. patent application Ser. No. 10/961,196 filed on Oct. 12, 2004 discloses a concealed adjustable temperature switch electrically connected to a heating member. The concealed adjustable temperature switch comprises a fixed plate with a screw hole, an adjusting block having an outer threading threadedly engaged with the screw hole of the fixed plate, a bimetal plate that has different bending extents at different temperatures, and a metal plate. The bimetal plate is electrically connected to one of two electrodes, and the metal plate is electrically connected to the other electrode. A positioning ring is securely mounted on the adjusting block to turn therewith. The positioning ring is fixed on the adjusting block by a fixing ring. The positioning ring includes a projection. Two spaced stops are provided to stop the projection of the positioning ring, thereby limiting turning of the adjusting block. The positioning ring, the fixing ring, and the stops prevent the adjusting block from disengaging from the fixed plate and prevent the electric appliance from being damaged. However, in a case that the hot melt glue gun is disassembled, the positioning ring is disengaged from the stops such that the projection of the positioning ring could not be stopped by either stop. Unintentional rotation leading to overtight contact between the bimetal plate and the metal plate might occur, resulting in overheating and damage.

SUMMARY OF THE INVENTION

An objective of the present invention is to provide a concealed adjustable temperature switch for preventing damage to an electric appliance due to overheating even if the hot melt glue gun has been disassembled.

A concealed adjustable temperature switch in accordance with the present invention is electrically connected to a heating member and comprises a fixed plate with a screw hole, an adjusting block having an outer threading threadedly engaged with the screw hole of the fixed plate, a bimetal plate that has different bending extents at different temperatures, and a metal plate. The bimetal plate is electrically connected to one of two electrodes and the metal plate is electrically connected to the other electrode.

An upper positioning ring, a fixing ring, and a lower positioning ring are securely mounted on the adjusting block to turn therewith. The fixing ring is mounted between the upper positioning ring and the lower positioning ring. The fixed ring includes a hole through which the adjusting block extends. The fixing ring includes a stop projecting toward the fixed plate. The stop includes two sides having a height greater than a thickness of the fixed plate.

A distance between the stop and a center of the hole of the fixing ring is greater than that between a front edge of the fixed plate and a center of the screw hole of the fixed plate. The distance between the stop and the center of the hole of the fixing ring being greater than that between either one of two sides of the fixed plate to the center of the screw hole of the fixed plate.

Preferably, each of the upper positioning ring and the lower positioning ring comprises a plurality of projections. The fixing ring comprises a plurality of teeth on a circumference thereof. A groove is defined between a pair of protrusions of the fixing ring adjacent to each other. The projections of the upper and lower positioning rings are received in the grooves.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
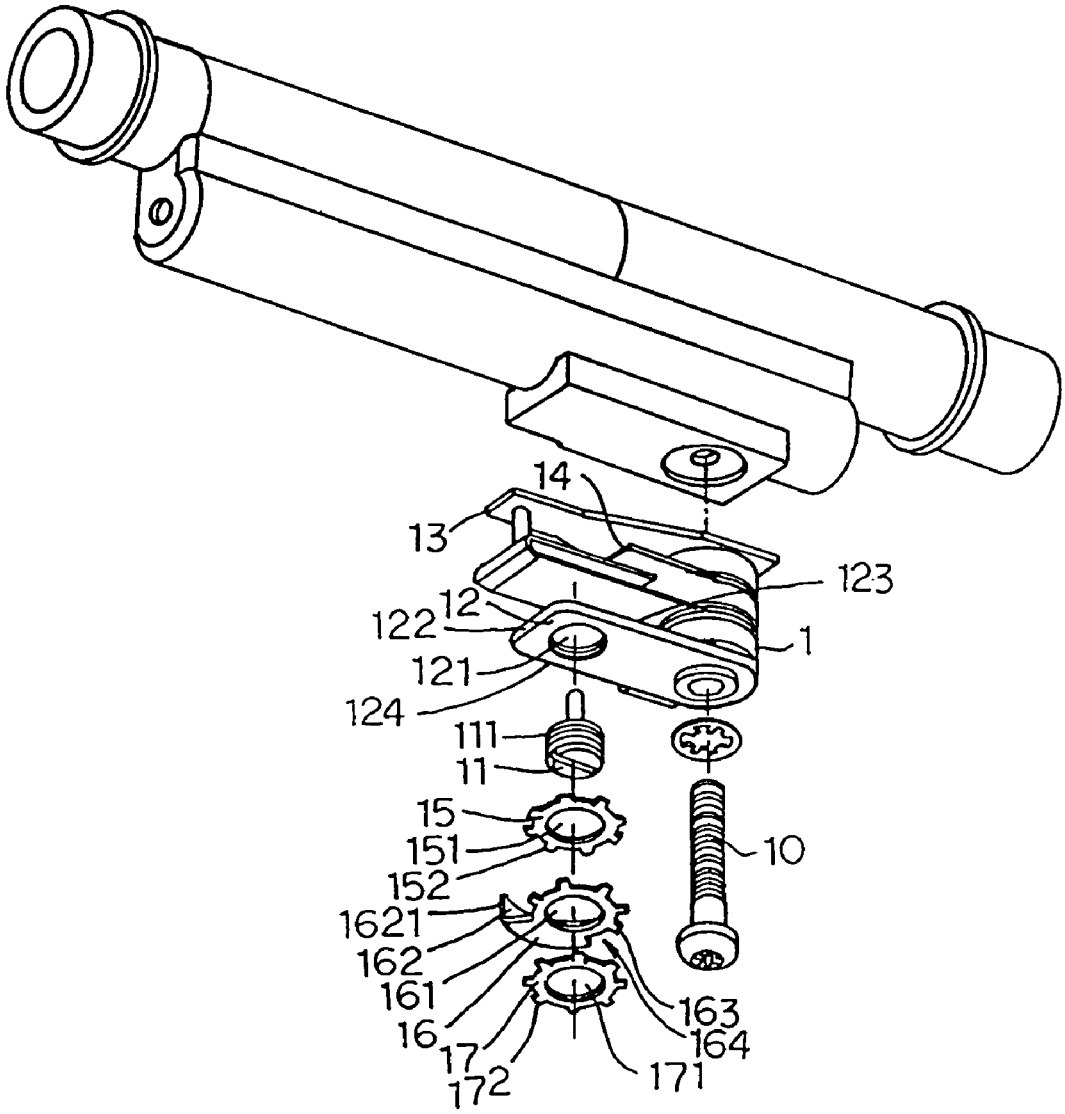
FIG. 1 is an exploded perspective view of a portion of a hot melt glue gun and a concealed adjustable temperature switch in accordance with the present invention.
Figure 2:
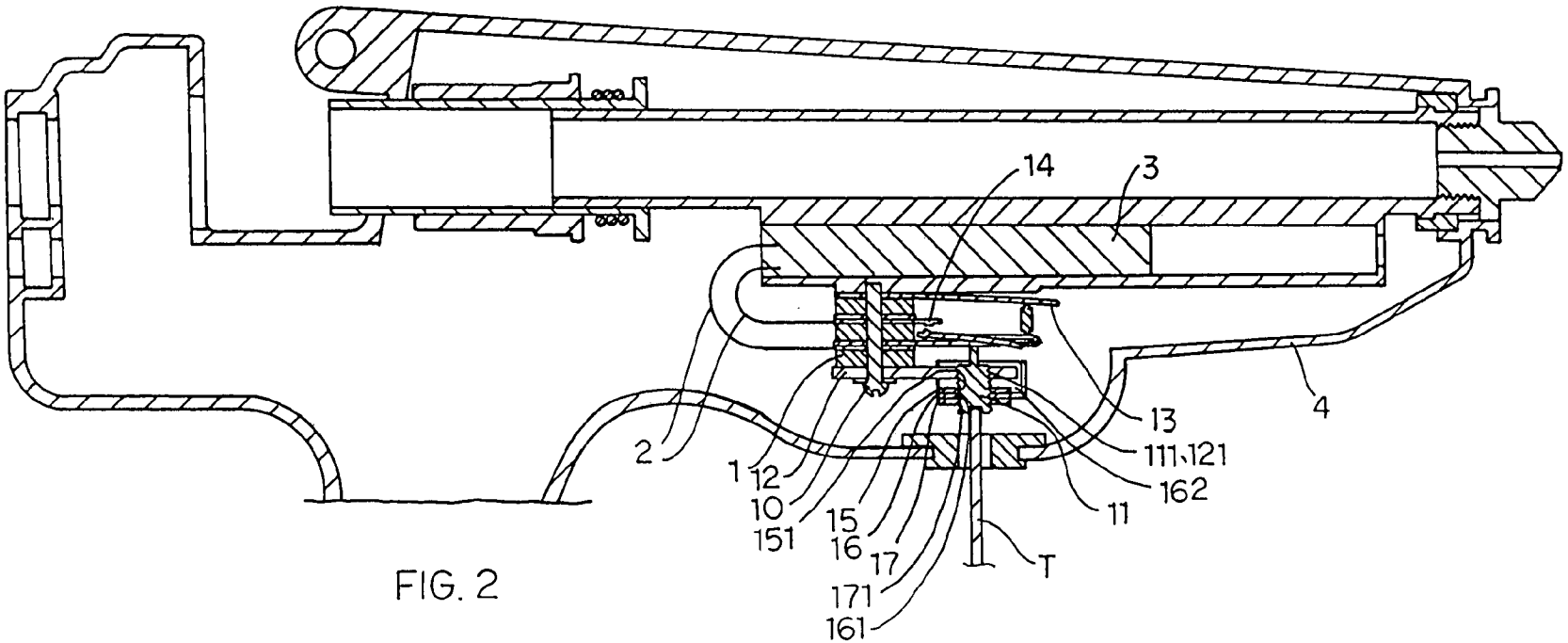
FIG. 2 is the hot melt glue gun with the concealed adjustable temperature switch in accordance with the present invention.

FIGS. 1 and 2 illustrates a holt melt glue gun comprising a body 4 and a concealed adjustable temperature switch 1 mounted in the body 4 and electrically connected by wires 2 to a heating member 3 in the body 4. The adjustable temperature switch 1 includes an adjusting block 11 with an outer threading 111, a fixed plate 12 with a screw hole 121, a bimetal plate 13, and a metal plate 14. The bimetal plate 13 includes a first plate and a second plate that are bonded together, wherein the bimetal plate 13 has different bending extents at different temperatures. The outer threading 111 of the adjusting block 11 is threadedly engaged with the screw hole 121 of the fixed plate 12. The bimetal plate 13 is electrically connected to an electrode, and the metal plate 14 is electrically connected to the other electrode.

A tool T can be extended into the body 4 to turn the adjusting block 11, moving the adjusting block 11 toward or away from the bimetal plate 13 to thereby cause the bimetal plate 13 to be in tight contact or loose contact with the metal plate 14. When the adjusting block 11 is turned in a direction, the adjusting block 11 moves toward the bimetal plate 13 and causes the bimetal plate 13 to be in loose contact with the metal plate 14. In this case, slight bending of the bimetal plate 13 at a relatively low temperature is sufficient to cause disengagement of the bimetal plate 13 from the metal plate 14, resulting in an open circuit. Thus, electricity supply to the heating member 3 is stopped.

On the other hand, when the adjusting block 11 is turned in a reverse direction, the adjusting block 11 moves away from the bimetal plate 13 and causes the bimetal plate 13 to be in tight contact with the metal plate 14. In this case, greater bending of the bimetal plate 13 at a relatively high temperature is required to cause disengagement of the bimetal plate 13 from the metal plate 14 to cut off electricity supply to the heating member 3.

Of more importance, the concealed adjustable temperature switch 1 comprises an upper positioning ring 15, a fixing ring 16, and a lower positioning ring 17. The upper positioning ring 15 and the lower positioning ring 17 are respectively mounted on upper and lower sides of the fixing ring 16. Each of the upper positioning ring 15 and the lower positioning ring 17 includes a screw hole 151, 171 threadedly engaged with the outer threading 111 of the adjusting block 11. Thus, the upper positioning ring 15 and the lower positioning ring 17 are securely mounted on the adjusting block 11. Further, each of the upper positioning ring 15 and the lower positioning ring 17 includes a plurality of projections 152, 172.

The fixing ring 16 includes a hole 161 through which the adjusting block 11 extends. The fixing ring 16 includes a stop 162 projecting toward the fixed plate 12. A plurality of teeth 163 are formed on a circumference of the fixing ring 16. The stop 162 has two sides 1621 and 1622 having a height greater than a thickness of the fixed plate 12. Further, the distance between the stop 162 and the center of the hole 161 of the fixing ring 16 is greater than that between a front edge 122 of the fixed plate 12 and the center of the screw hole 12. Also, the distance between the stop 162 and the center of the hole 161 of the fixing ring 16 is greater than that between either side 123, 124 of the fixed plate 12 to the center of the screw hole 121. A groove 164 is defined between a pair of projections 163 of the fixing ring 16 adjacent to each other. The projections 152 and 172 of the upper and lower positioning rings 15 and 17 are received in the grooves 164. Thus, the upper end and the lower end of the fixing ring 16 are in contact with the upper and lower positioning rings 15 and 17 and engaged on the adjusting block 11.

Figure 3:
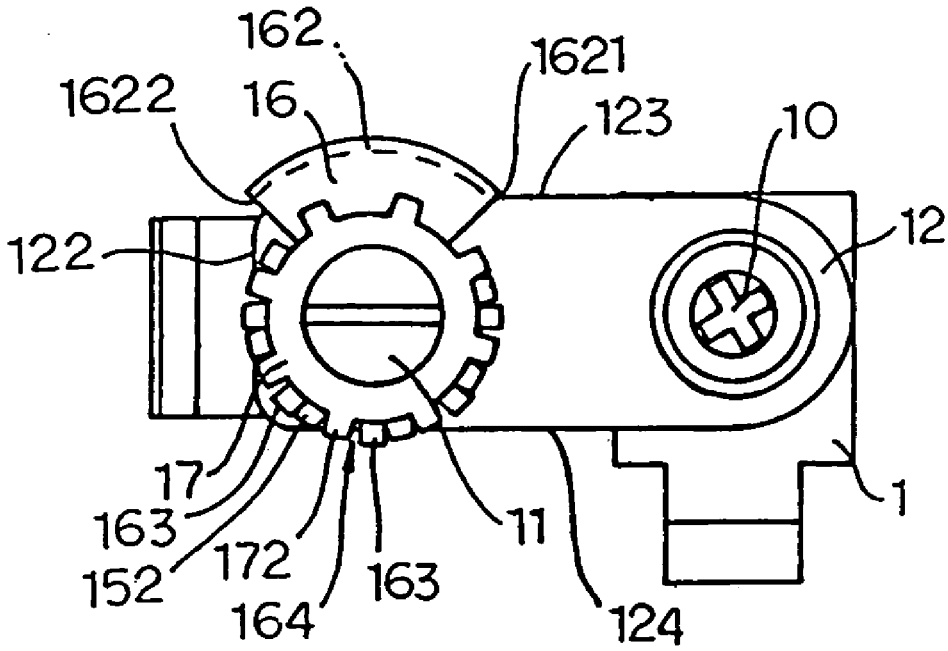
FIG. 3 is a front view illustrating adjusting of the concealed adjustable temperature switch in a direction.
Figure 4:
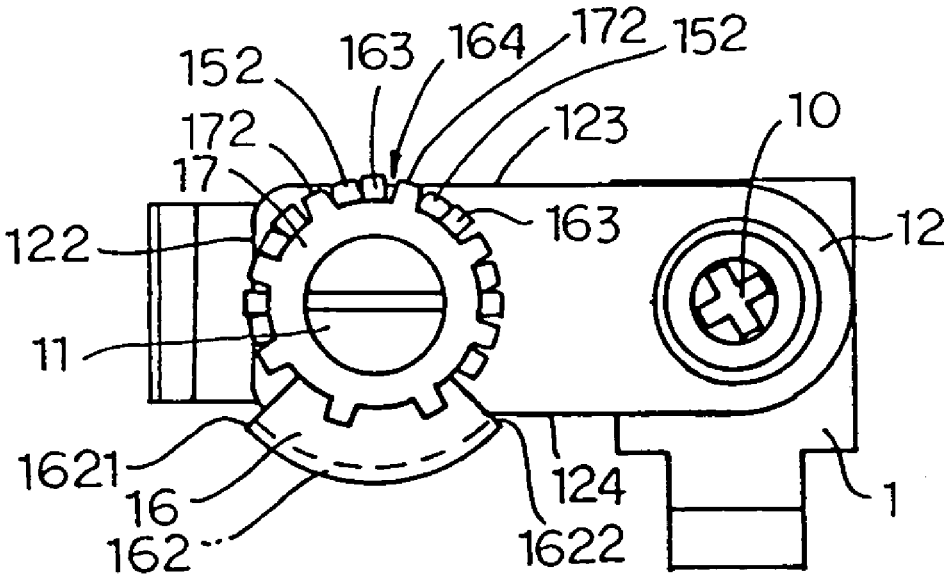
FIG. 4 is a view similar to FIG. 3, illustrating adjusting of the concealed adjustable temperature switch in a reverse direction.
Figure 5:
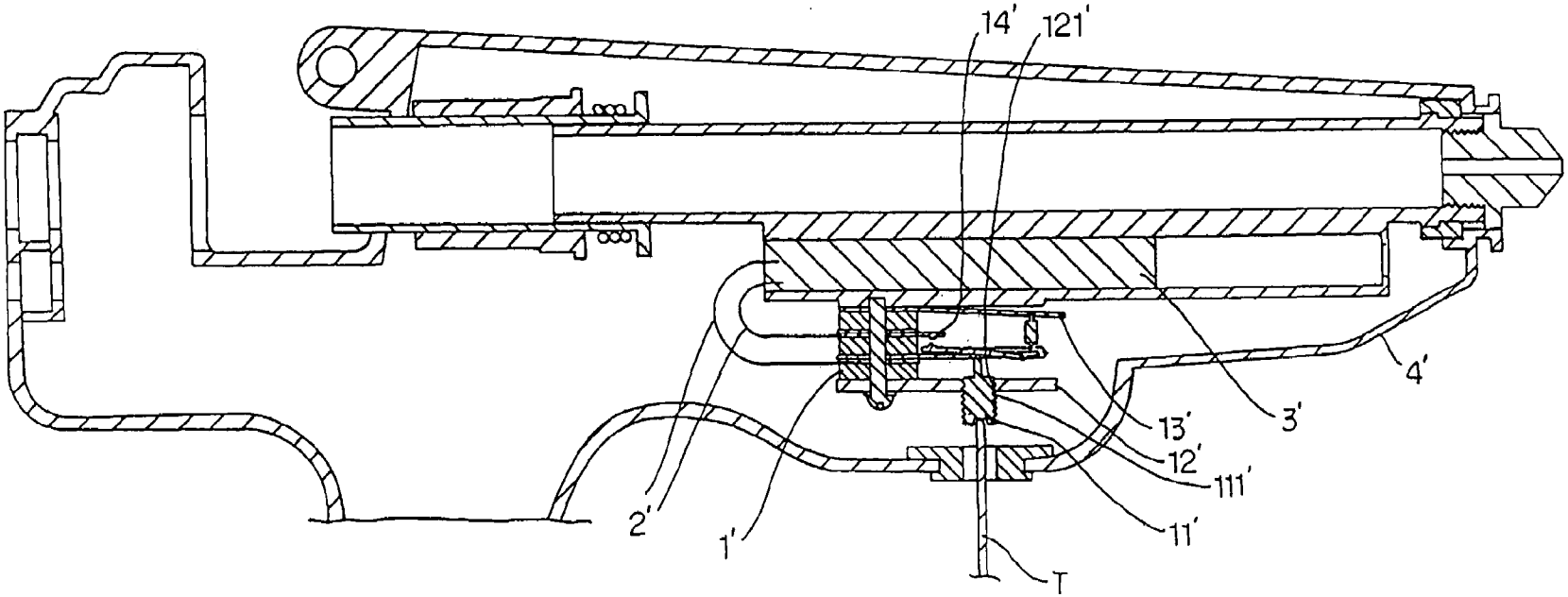
FIG. 5 PRIOR ART
FIG. 5 is a sectional view of a hot melt glue gun with a conventional concealed adjustable temperature switch.

Referring to FIGS. 3 and 4, when the adjusting block 11 is turned in either direction, the stop 162 of the fixing ring 16 is moved and stopped by an associated side 123, 124 of the fixed plate 12, preventing further rotation of the adjusting block 11 and avoiding overtight contact between the bimetal plate 13 and the metal plate 14 resulting from inadvertent rotation of the adjusting block 11. A safety adjustable temperature control switch is thus obtained.

Although a specific embodiment has been illustrated and described, numerous modifications and variations are still possible without departing from the essence of the invention. The scope of the invention is limited by the accompanying claims.

What is claimed is:

1. A concealed adjustable temperature switch electrically connected to a heating member, the concealed adjustable temperature switch comprising a fixed plate with a screw hole, an adjusting block having an outer threading threadedly engaged with the screw hole of the fixed plate, a bimetal plate that has different bending extents at different temperatures, and a metal plate, the bimetal plate being electrically connected to one of two electrodes, the metal plate being electrically connected to the other electrode, an upper positioning ring, a fixing ring, and a lower positioning ring being securely mounted on the adjusting block to turn therewith, the fixing ring being mounted between the upper positioning ring and the lower positioning ring, the fixing ring including a hole through which the adjusting block extends, the fixing ring including a stop projecting toward the fixed plate, the stop including two sides having a height greater than a thickness of the fixed plate, a distance between the stop and a center of the hole of the fixing ring being greater than that between a front edge of the fixed plate and a center of the screw hole of the fixed plate, the distance between the stop and the center of the hole of the fixing ring being greater than that between either one of two sides of the fixed plate to the center of the screw hole of the fixed plate.

2. The concealed adjustable temperature switch as claimed in claim 1 wherein each of the upper positioning ring and the lower positioning ring comprises a plurality of projections, the fixing ring comprising a plurality of teeth on a circumference thereof, a groove being defined between a pair of protrusions of the fixing ring adjacent to each other, the projections of the upper and lower positioning rings being received in the grooves.

* * * * *